US007448873B2

(12) United States Patent
Weber

(10) Patent No.: US 7,448,873 B2
(45) Date of Patent: Nov. 11, 2008

(54) CONNECTOR ASSEMBLY FOR END MOUNTING PANEL MEMBERS

(75) Inventor: Ronald Martin Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/620,821

(22) Filed: Jan. 8, 2007

(65) Prior Publication Data

US 2008/0166901 A1 Jul. 10, 2008

(51) Int. Cl.
*H01R 39/00* (2006.01)

(52) U.S. Cl. ..... 439/31

(58) Field of Classification Search ..... 439/65, 439/79, 80, 947, 857, 284, 31
See application file for complete search history.

(56) References Cited

U.S. PATENT DOCUMENTS 4,632,475 A * 12/1986 Tomita ..... 439/1
4,657,320 A * 4/1987 Bamford et al. ..... 439/31
4,865,553 A * 9/1989 Tanigawa et al. ..... 439/31
5,727,961 A * 3/1998 Landis et al.
7,179,108 B2 * 2/2007 Goodman et al. ..... 439/284

FOREIGN PATENT DOCUMENTS

EP 0 142 922 A * 5/1985
GB 2 192 496 A * 1/1988

* cited by examiner

*Primary Examiner*—Phuong K Dinh

(57) ABSTRACT

A connector assembly is secured to a panel member for electrically coupling with a second connector assembly secured to a second panel member. Each of the connector assemblies includes a first contact having a first portion and a second portion disposed at a first predetermined spacing from each other. A second contact is disposed a second predetermined spacing from the second portion, the first predetermined spacing of the first contact being configured and disposed to receive the second contact of the second connector assembly. The second contacts and corresponding first contacts of the connector assembly and second connector assembly are capable of forming pivotable connections.

18 Claims, 10 Drawing Sheets

CONNECTOR ASSEMBLY FOR END MOUNTING PANEL MEMBERS

FIELD OF THE INVENTION

The present invention relates generally to electrical connector assemblies and, more particularly, to electrical connector assemblies for use with electrical panel members.

BACKGROUND OF THE INVENTION

Connector assemblies are required to provide electrical power or electrical or electronic control signals between components, such as computers, printers, auxiliary hardware, etc. Often, these components contain panel members, such as printed circuit boards, which are populated with miniaturized components to provide the desired electrical control. Typically, the connector assembly includes electrical contacts that extend from a housing that is secured adjacent to one end of the panel member. A mating connector assembly is configured for receiving the connector assembly. The operational reliability of the component is directly affected by the integrity of the connection. That is, if there is an insufficient electrical connection between the contacts, the components cannot operate as intended.

In addition, the electrical connector assemblies between adjacent panel members are configured to permit coupling by directing the electrical connector assemblies toward each other in only one direction.

What is needed is an electrical connector assembly that is secured to a panel member, which connector assembly being configured to couple with a second connector assembly that is secured to a second panel member, the connector assemblies capable of being brought into electrical contact with each other from a plurality of different directions.

SUMMARY OF THE INVENTION

The present invention relates to a connector assembly secured to a panel member for electrically coupling with a second connector assembly secured to a second panel member. Each of the connector assemblies includes a first contact having a first portion and a second portion disposed at a first predetermined spacing from each other. A second contact is disposed a second predetermined spacing from the second portion, the first predetermined spacing of the first contact being configured and disposed to receive the second contact of the second connector assembly. The second contacts and corresponding first contacts of the connector assembly and second connector assembly are capable of forming pivotable connections.

The present invention further relates to a panel member electrically connectable to a second panel member. The panel member includes a connector assembly secured to the panel member for electrically coupling with a second connector assembly secured to the second panel member. Each of the connector assemblies includes a first contact having a first portion and a second portion disposed at a first predetermined spacing from each other. A second contact is disposed a second predetermined spacing from the second portion, the first predetermined spacing of the first contact being configured and disposed to receive the second contact of the other connector. The second contacts and corresponding first contacts of the connector assembly and second connector assembly are capable of forming pivotable connections.

An advantage of the present invention is that mating electrical connector assemblies form pivotable connections.

A further advantage of the present invention is that the mating electrical connector assemblies can be brought together from different directions.

A still further advantage of the present invention is that the panel members of mating electrical connector assemblies are capable of remaining at a fixed orientation with respect to each other.

A yet further advantage of the present invention is that the orientation between panel members permits changes in orientation with respect to each other.

A still yet further advantage of the present invention is that it reduces the number of component parts required to manufacture the connector assemblies.

A further advantage is that the connector assembly is hermaphroditic in nature.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
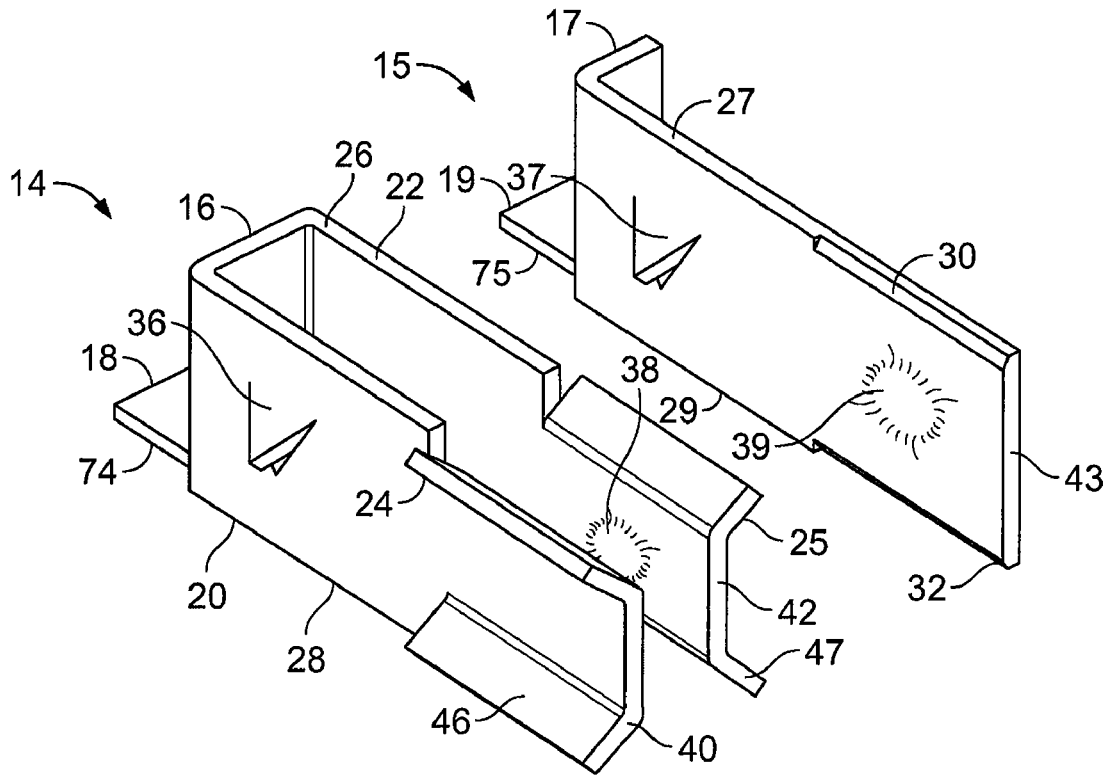
FIG. 1 is a top perspective view of an embodiment of an electrical contact construction of the present invention.
Figure 6:
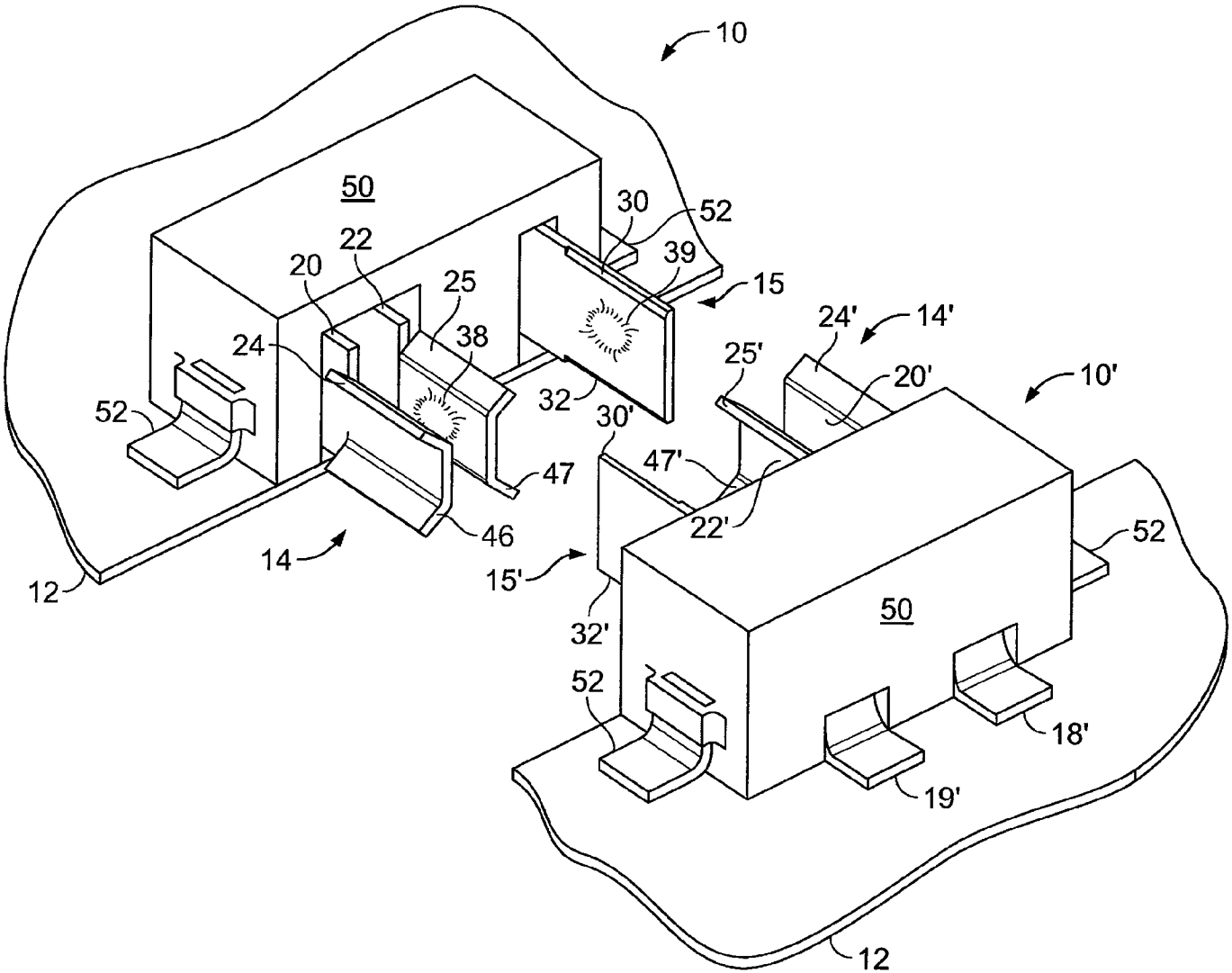
FIG. 6 is a top perspective view of mating electrical connector assemblies prior to coupling secured to respective panel members of the present invention.

Referring to FIGS. 1-4, an electrical connector assembly 10 (FIG. 4) according to the present invention includes an arrangement of contacts 14, 15 that is configured to couple with another arrangement of contacts 14', 15' (FIG. 6). In one embodiment, as shown in FIG. 1, contact 14 includes a base 16 extending from one end to a first portion 20 and from the other end to a second portion 22. First portion 20 extends to an end 40 opposite base 16 and second portion 22 extends to an end 42 opposite base 16. In one embodiment, base 16, first and second portions 20, 22 each have an upper end 26 and a lower end 28, and first and second portions 20, 22 are substantially parallel. It is to be understood that the terms upper and lower are not limiting, but merely provided to more easily identify features of the present invention. Contact 15 includes a base 17, said contact 15 extending from base 17 to an end 43. In one embodiment, contact 15, including base 17, includes an upper end 27 and a lower end 29.

As shown in FIG. 1, a foot 18 extends outwardly and substantially transverse to base 16 of contact 14 and has a surface 74 substantially coincident with or slightly lower than lower end 28. Similarly, a foot 19 extends outwardly and substantially transverse to base 17 of contact 15 and has a surface 75 substantially coincident with or slightly lower than lower end 29. In another embodiment of contact 14 (FIG. 2), surface 74 of foot 18 extends past, or below, lower end 28, and a foot 44 having a surface 76 extends transversely from lower end 28 of first portion 20, in effect, raising contact 14 so that when contact 14 is placed upon a substantially flat surface, respective surfaces 74, 76 of feet 18, 44 are in contact with the flat surface. As further shown in FIG. 2 with regard to contact 15, surface 75 of foot 19 extends past, or below, lower end 29, and a foot 45 having a surface 77 extends transversely from lower end 29, in effect, raising contact 15 so that when contact 15 is placed upon a substantially flat surface, respective surfaces 75, 77 of feet 19, 45 are in contact with the flat surface.

Figure 7:
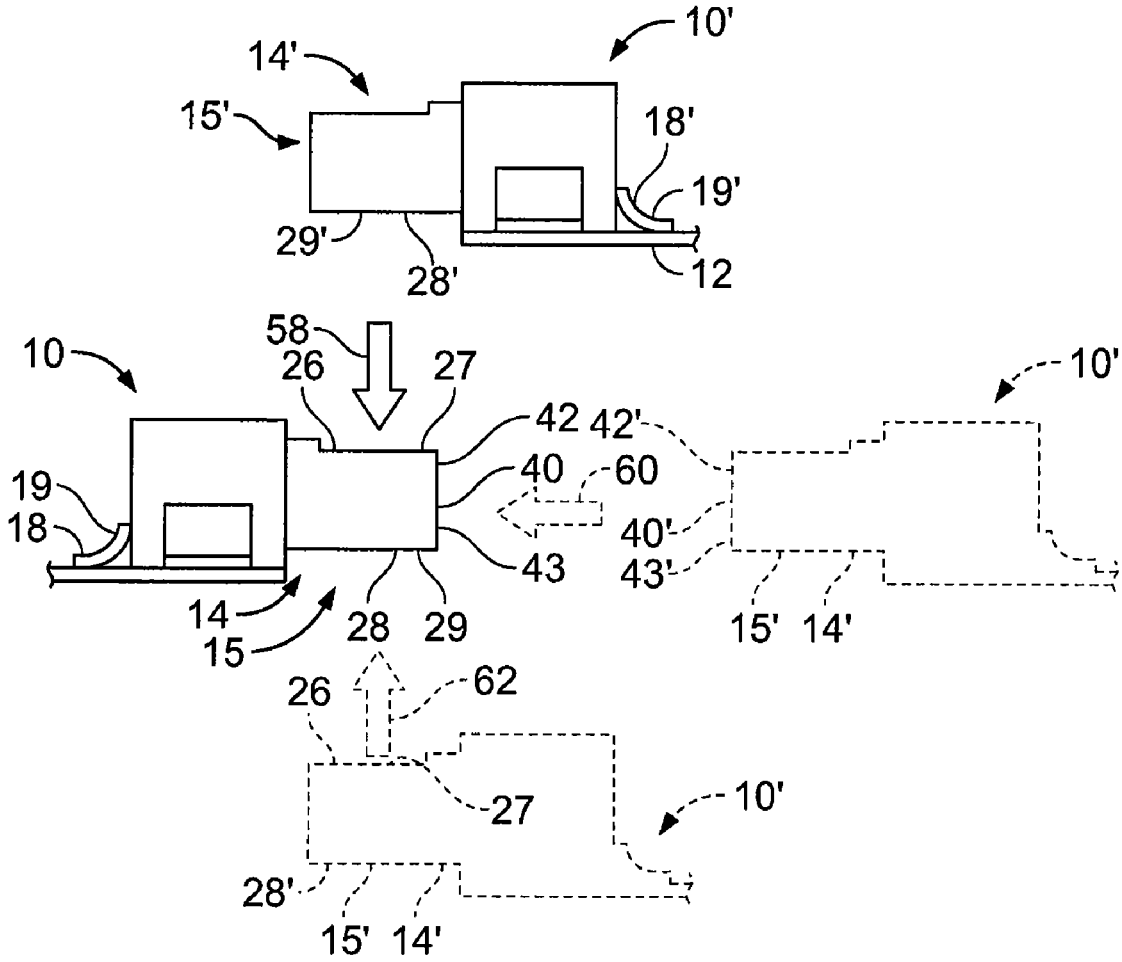
FIG. 7 is a schematic elevation view of mating electrical connectors of the present invention, showing a plurality of directions in which the connectors can be brought together.

As shown in FIGS. 6 and 7, foot 18, 18', 19, 19' and foot 44, 45 (not shown) can be used to securely mount respective contacts 14, 14', 15, 15' to a corresponding panel member 12. In one mounting technique (not shown), a solder containing paste is masked onto the surface of panel member 12 so that foot 18, 44 and/or foot 19, 45 is disposed on the paste. Panel member 12 is then subjected to sufficient heat to flow the paste, establishing a bonded joint between panel member 12 and each foot 18, 19, 44, 45 (FIG. 2) or between panel member 12 and foot 18, 19 (FIG. 1). However, other suitable conductive fastening techniques, including mechanical fasteners, adhesives or other thermal processes can be used to secure foot 18, 19 or feet 18, 19, 44, 45 to panel member 12.

Figure 3:
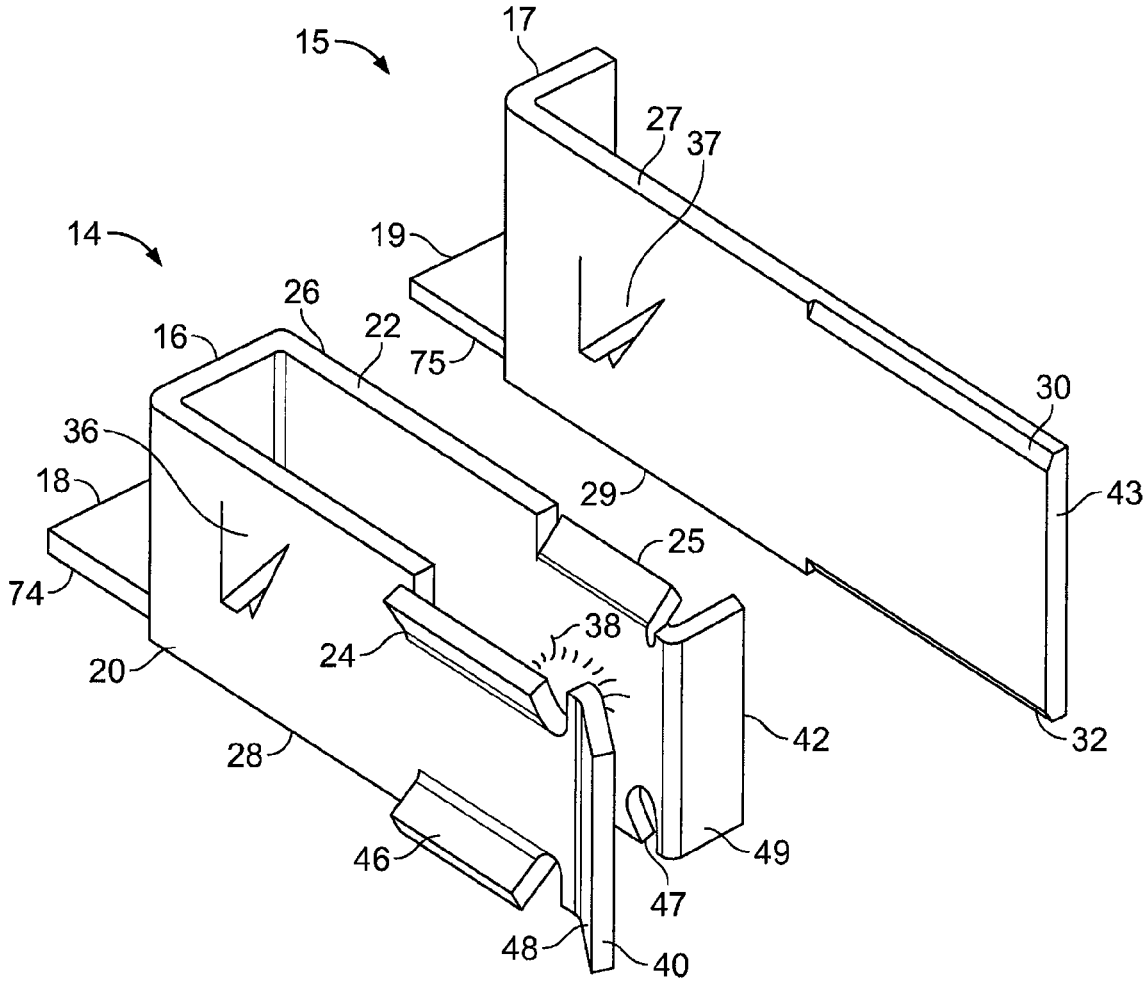
FIG. 3 is a top perspective view of a further embodiment of an electrical contact construction of the present invention.
Figure 4:
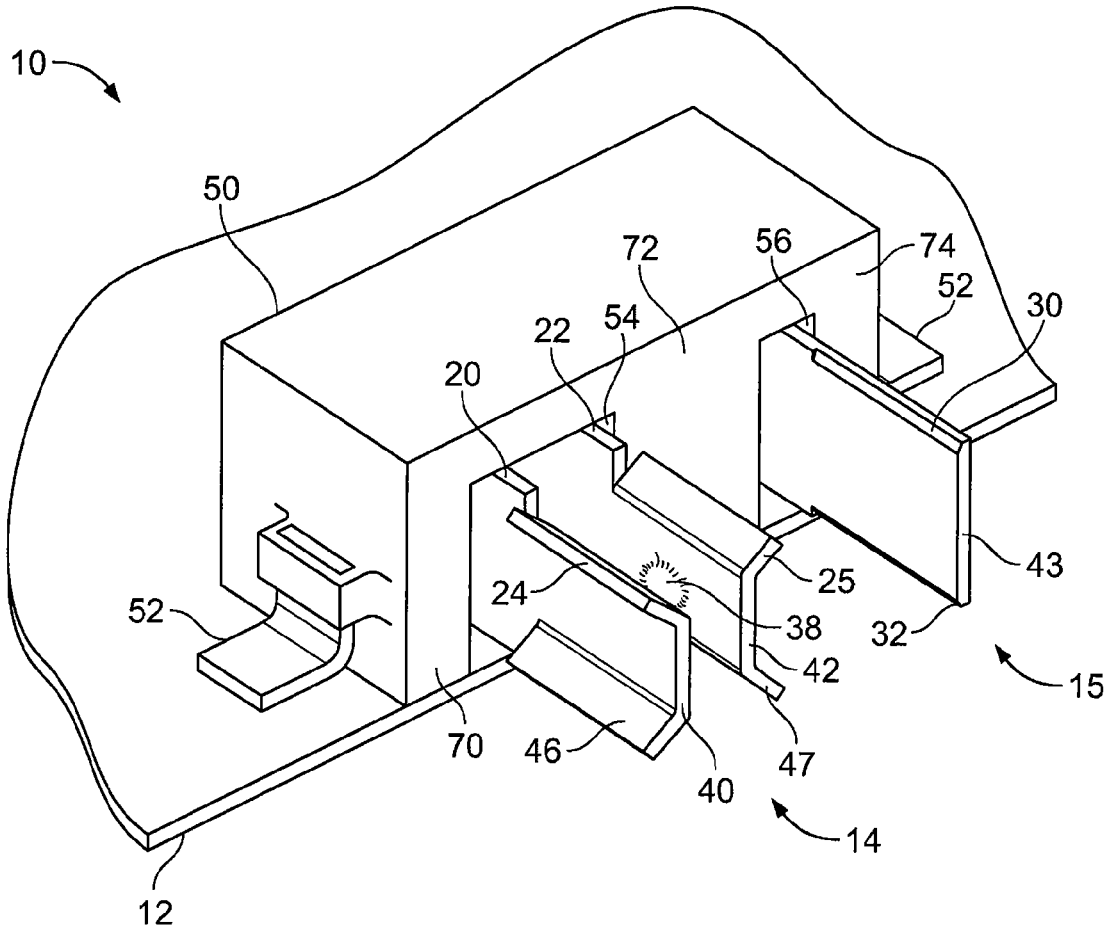
FIG. 4 is a top perspective view of an embodiment of a connector assembly secured to a panel member of the present invention.

In one embodiment, an interfering retainer 36 (FIG. 1) is formed in each of first portion 20 and second portion 22 to secure contact 14 to a housing 50 (FIG. 4). In addition, a retainer 37 (FIG. 1) is formed in contact 15 to secure contact 15 to a housing 50 (FIG. 4). Further, FIG. 1 shows an angled region 24 formed adjacent to upper end 26 and end 40 of first portion 20, and an angled region 46 formed adjacent to lower end 28 and end 40 of first portion 20. Also, as shown in FIG. 1, angled region 25 is formed adjacent to upper end 26 and end 42 of second portion 22, and an angled region 47 is formed adjacent to lower end 28 and end 42 of second portion 22. As further shown in FIG. 1, a taper 30 is formed in contact 15 adjacent to upper end 27 and end 43, and a taper 32 is formed in contact 15 adjacent to lower end 29 and end 43. As shown in FIGS. 1-4, an optional protrusion 38 extends outwardly from second portion 22 toward first portion 20 to provide an improved electrical connection with a mating connector. It is to be understood that protrusion 38 could also extend outwardly from first portion 20 toward second portion 22, or protrusion 38 could be formed in each of first and second portions 20, 22. In addition, an optional protrusion 39 extends outwardly from contact 15 (FIG. 1). For reasons discussed in further detail below, an arrangement of contacts 14, 15 forms a pivotable connection with a corresponding arrangement of contacts 14', 15' (FIG. 6).

Figure 2:
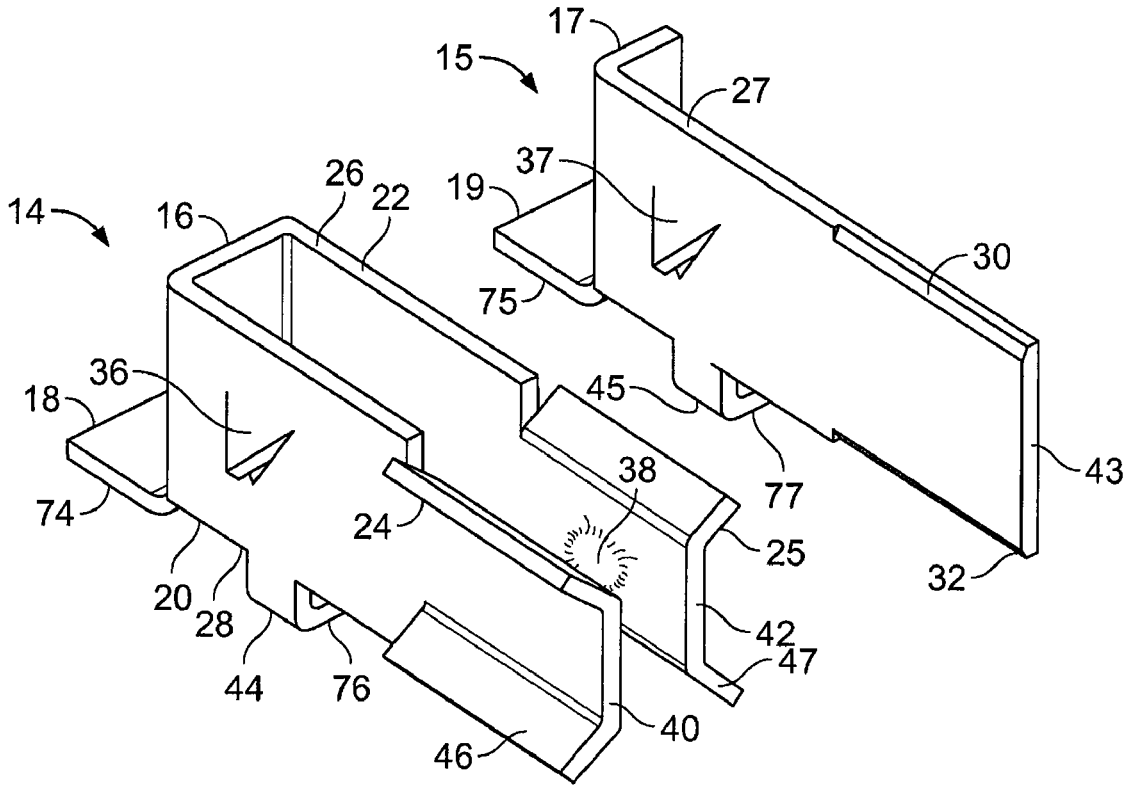
FIG. 2 is a top perspective view of an embodiment of an electrical contact construction of the present invention.

Referring to FIG. 3, which is another embodiment of contact 14 that is otherwise similar to the contact 14 embodiment of FIG. 2, an angled portion 48 is formed adjacent to end 40 of first portion 20. In addition, an angled portion 49 is formed adjacent to end 42 of second portion 22. Angled portions 48, 49 provide a lead-in transition to facilitate end mating, such as by direction 60, as shown in FIG. 7. It is to be understood that angled portions 24, 46, 25, 47, 48, 49 can extend along a portion of the periphery adjacent respective ends 40, 42 of first and second portions 20, 22, or extend substantially contiguously along the periphery adjacent respective ends 40, 42 of first and second portions 20, 22.

Referring to FIG. 6, contacts 14, 15 are composed of a metal such as brass or phosphor bronze, or other sufficiently electrically conductive material so that electrical energy is conducted from feet 18, 44, 45 (44, 45 not shown in FIG. 6) through first and second portions 20, 22 of contact 14 and contact 15 to an arrangement of mating contacts 14', 15' in a manner that does not substantially adversely affect the performance of components mounted to each panel member 12.

Referring to FIG. 4, a housing 50 includes an opening 54 configured to receive contact 14 and an opening 56 configured to receive contact 15. To mechanically secure housing 50 to panel member 12, a foot 52, or a plurality of feet 52, that is secured to housing 50 is brought into contact with panel member 12, foot 52 being secured to panel member 12. Foot 52 can be secured to panel member 12 in a manner similar to the technique used to secure feet 18, 44 to panel member 12 as previously discussed. In one embodiment of housing 50, contact 14 is secured to housing 50 by virtue of retainers 36 (FIG. 1) that engage opposing walls of opening 54, and contact 15 is secured to housing 50 by virtue of retainer 37 (FIG. 1) that engages one wall of opening 56. As shown in FIG. 4, housing 50 is configured so that first and second portions 20, 22 and contact 15 are disposed substantially perpendicular to panel member 12. Also as shown in FIG. 4, angled regions 24, 46, 25, 47 and tapers 30, 32 extend outwardly from housing 50 through openings 54, 56. In an alternate embodiment, front surface portions 70, 72, 74 of housing 50 can extend outwardly toward ends 40, 42 of first and second portions 20, 22 and end 43 of contact 15 to vertically separate and enclose first and second portions 20, 22 and contact 15. Housing 50 can be composed of any material having sufficient electrical insulating properties and strength and stiffness properties suitable for use with connector assembly 10, such as nylon or polyester thermoplastics.

Figure 5:
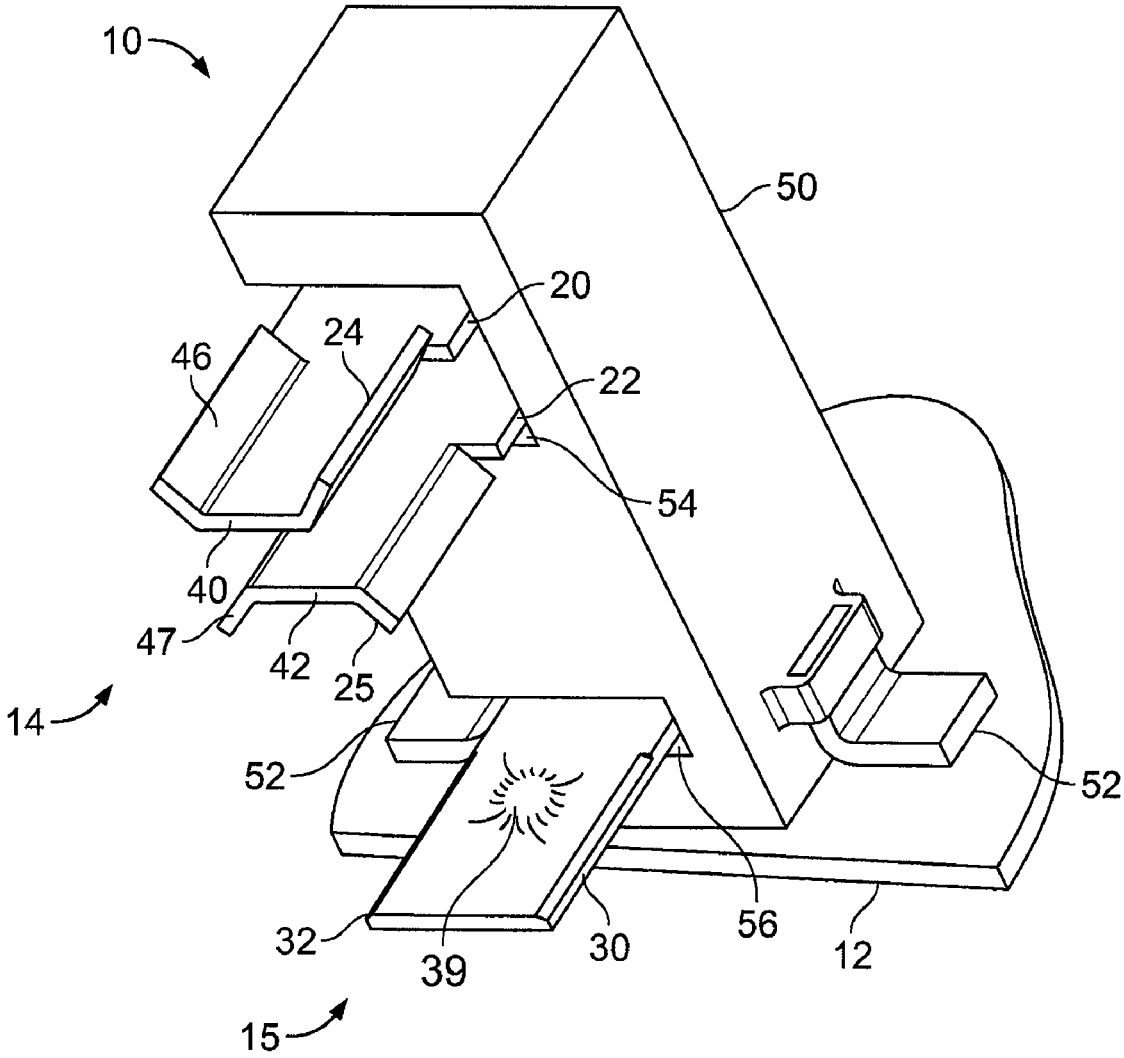
FIG. 5 is a top perspective view of an embodiment of a connector assembly secured to a panel member of the present invention.
Figure 14:
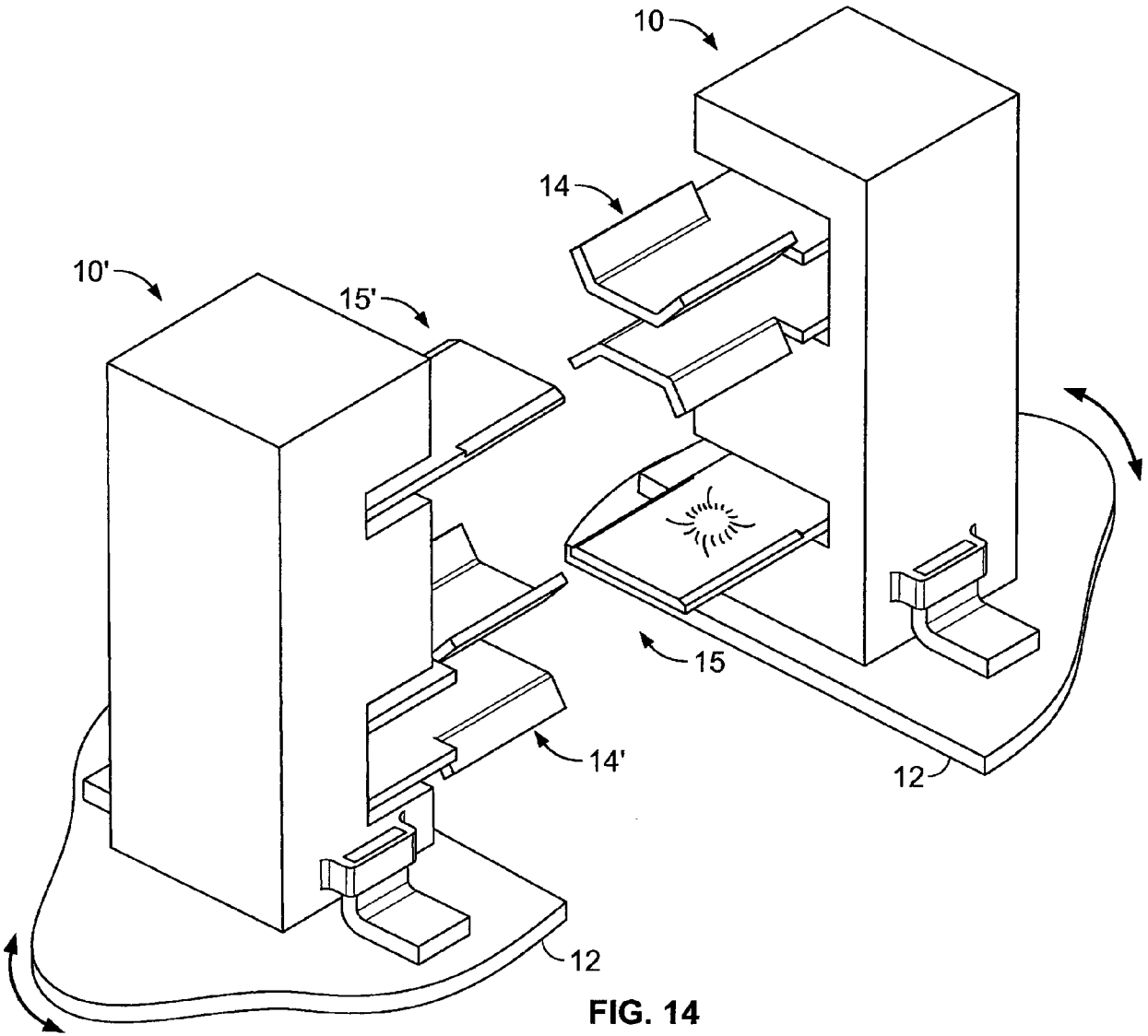
FIG. 14 is a top perspective view of mating electrical connector assemblies prior to coupling, with connector assemblies configured similar to FIG. 5, secured to respective panel members of the present invention.

Referring to FIG. 5, housing 50 is similar to the embodiment of FIG. 4, except that housing 50 in FIG. 5 is configured to secure contacts 14 so that first and second portions 20, 22 of contact 14 and contact 15 are arranged horizontally along the surface of panel member 12, i.e., substantially parallel to panel member 12, with contacts 14, 15 disposed substantially perpendicular, i.e., stacked vertically, to the panel member 12. In other words, as shown in FIG. 5, housing 50 is configured to secure contacts 14, 15 so that first and second portions 20, 22 of contact 14 and contact 15 are arranged vertically along a portion of panel member 12 with first and second portions of contact 14 and contact 15 disposed substantially parallel to panel member 12. Upon connecting contacts 14, 15 of the connector assemblies 10 of each of FIGS. 4 and 5, panel members 12 would be perpendicular to each other. Alternately, connecting two panel members 12 as shown in FIG. 14 with mating connector assemblies similar in nature to that shown in FIG. 5, permits panel members 12 to rotate substantially in the plane of the panel members 12, the extent of rotation being limited by the mating panel member 12.

FIG. 6 shows mating connector assemblies 10, 10' aligned for coupling, each connector assembly 10, 10' secured to a respective panel member 12. Upon directing each connector assembly 10' into engagement with its respective connector assembly 10, contact 15' is received between corresponding first and second portions 20, 22 of contact 14. Likewise, contact 15 of connector assembly 10 is received between corresponding first and second portions 20', 22' of contact 14' of connector assembly 10'. Due to the construction of contacts 14, 15 of connector assembly 10 and contacts 14', 15' of connector assembly 10', as shown by FIG. 7, connector assemblies 10, 10' can be brought together from a plurality of directions. For example, contacts 14', 15' of connector assembly 10' can be brought into mating contact or coupled with contacts 14, 15 of connector assembly 10 along direction 58, for example. That is, from a position vertically above contacts 14, 15, contacts 14', 15' can be lowered along direction 58 so that lower end 28' of contact 14' and lower end 29' of contact 15' engage upper end 26 of contact 14 and upper end 27 of contact 15 until full engagement or coupling is achieved. It is to be understood that, in one embodiment, connector assemblies 10, 10' are substantially the same and mate due to their hermaphroditic nature.

Alternately, contacts 14, 15 of connector assembly 10 and contacts 14', 15' of connector assembly 10' can be coupled or brought together to achieve mating contacts 68 (FIG. 7) along direction 60, for example. In other words, where contacts 14, 14', 15, 15' are aligned, contacts 14', 15' can be moved along direction 60 so that ends 40, 42, 43 begin to engage ends 40', 42', 43' until full engagement is achieved. Engagement along direction 60 can be made easier when one set of contact 14 (or 14') includes angled portion 48 (or 48') and/or angled portion 49 (or 49') (FIG. 3). In addition, contacts 14, 15 of connector assembly 10 and contacts 14', 15' of connector assembly 10' can be brought into mating contact or coupled with connector assembly 10 along direction 62, for example. That is, from a position vertically below contacts 14, 15 of connector assembly 10, contacts 14', 15' of connector assembly 10' can be raised along direction 62 so that upper end 26' of contact 14' and upper end 27' of contact 15' engage lower ends 28 of contact 14 and lower end 29 of contact 15 until full engagement or coupling is achieved.

Figure 8:
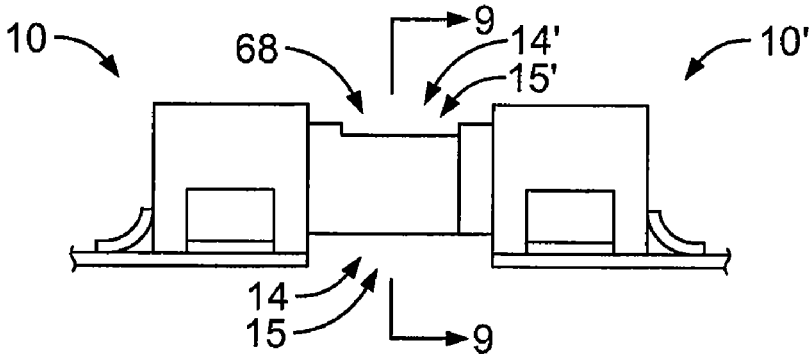
FIG. 8 is an elevation view of coupled electrical connector assemblies of the present invention.
Figure 13:
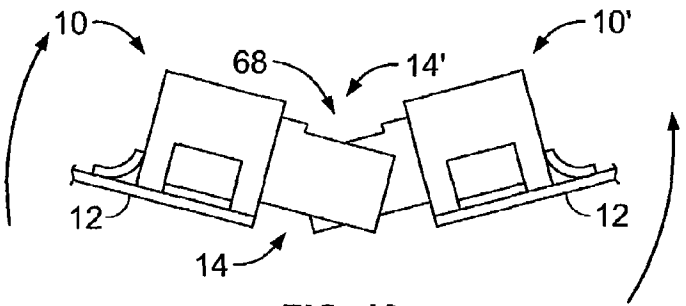
FIG. 13 is an elevation view similar to FIG. 8, except each coupled electrical connector assembly is rotated, i.e., pivotably connected, with respect to the other connector assembly of the present invention.

It is to be further noted that while connector assemblies 10, 10' can be brought together from a plurality of directions, by virtue of the pivotable or hinge-like connections, the panel assemblies 10, 10' can either be maintained parallel to each other, or continuously rotated with respect to each other, such as, maintained non-parallel to each other during assembly. That is, the term pivotable connection as used herein is defined to mean that in the case of mating contacts 14 and 14', each contact can be rotated with respect to each other, such as comparing FIGS. 8 and 13. In other words, as shown in FIG. 8, contacts 14 and 14' are mated so that corresponding panel members 12 are disposed substantially parallel to each other. As shown in FIG. 13, contacts 14 and 14' are rotated with respect to each other so that the corresponding panel members 12 are disposed at an angle to each other. However, while a pivotable connection as shown between FIGS. 8 and 13 are hinge-like, the pivotable connection is not constrained to rotate about a specific axis. Stated another way, unlike a hinge, the pivotable connection of the present invention lacks a hinge pin, thus permitting an amount of translational sliding movement between contacts 14 and 14'. In addition, as previously discussed with respect to mating the connector assemblies 10 of FIGS. 4, 5, alteration of housing 50 constructions can provide any orientation, i.e., any angular measurement, between panel members 12, which orientation being changeable, as desired.

Figure 9:
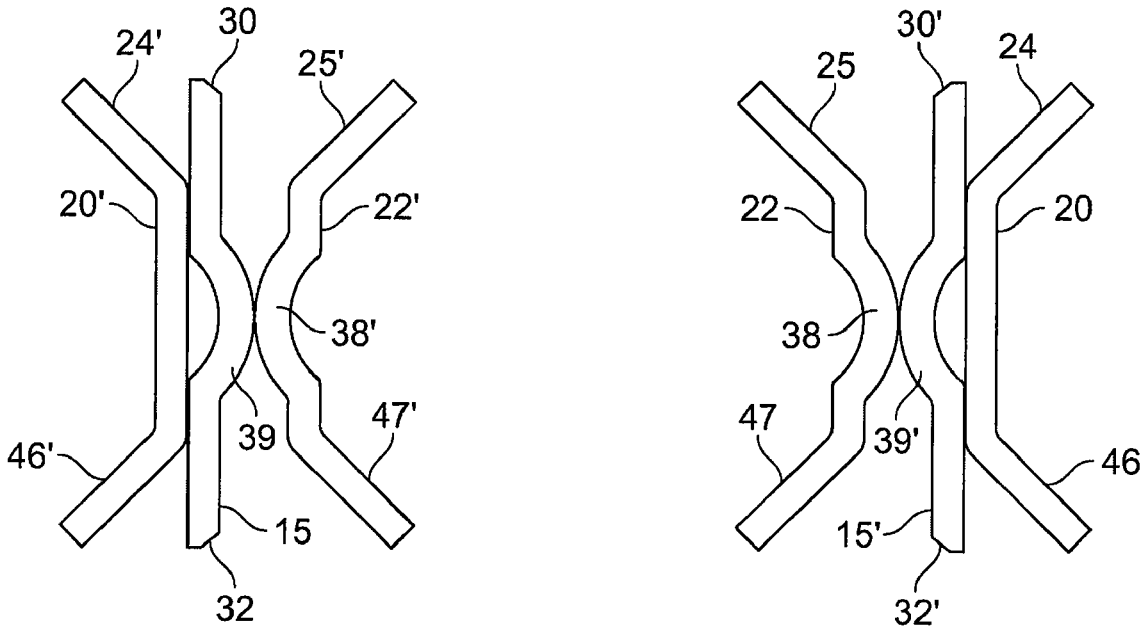
FIGS. 9-11 are cross sections of embodiments of mating connector contact constructions of the present invention.
Figure 10:
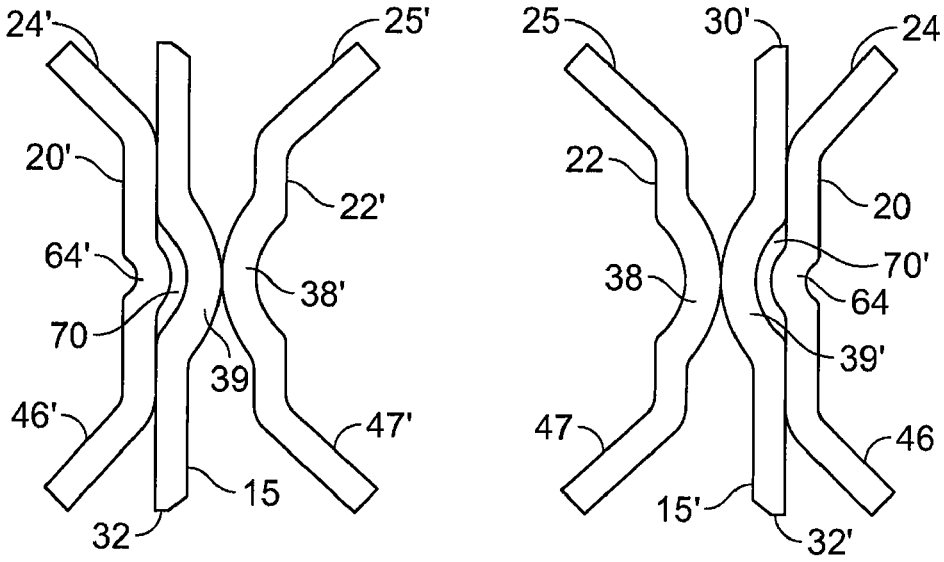

In addition to providing pivotable connections between coupled connector assemblies 10, 10', the connections achieved also provide an enhanced electrical connection therebetween. For example, FIG. 8 shows a pair of coupled electrical connector assemblies having mating contacts 68, also referred to as contacts 14, 14', 15, 15'. FIGS. 9-10 are cross sections each taken along line 9-9 of FIG. 8 for the pair of mating contacts 68 or contacts 14, 14', 15, 15'. For convenience, contacts 14, 14', 15, 15' are shown as identical components, with the only difference between corresponding portions being the superscripted apostrophe "'" following the numerical designation. Thus, in FIG. 9, contact 15 is secured between first portion 20' and second portion 22' of contact 14', and likewise, contact 15' is secured between first portion 20 and second portion 22 of contact 14. To enhance the electrical connection between mating contacts 68, protrusions 38, 38', 39, 39' can be employed, such as shown in FIGS. 1-3 for protrusions 38, 39. As shown in FIG. 9, protrusion 39' increases the effective thickness of contact 15', and is sized so that the effective thickness of contact 15' is greater than the distance between first and second portions 20, 22 of contact 14. Thus, upon the insertion of contact 15', including protrusion 39', between first and second portions 20, 22, first and second portions 20, 22 are urged further apart, producing a compressive contact force on opposite sides of contact 15' (including protrusion 39'). This compressive force provides improved electrical contact between the abutting portions of contact 15', including protrusion 39', and corresponding first and second portions 20, 22.

Similarly, as further shown in FIG. 9, protrusion 39 increases the effective thickness of contact 15, and is sized so that the effective thickness of contact 15 is greater than the distance between first and second portions 20', 22' of contact 14'. Thus, upon the insertion of contact 15, including protrusion 39, between first and second portions 20', 22', first and second portions 20', 22' are urged further apart, producing a compressive contact force on opposite sides of contact 15 (including protrusion 39). This compressive force provides improved electrical contact between the abutting portions of contact 15, including protrusion 39, and corresponding first and second portions 20', 22'. As shown in FIG. 9, protrusions 38, 39' and 38', 39 abut each other. While protrusions 38, 38', 39, 39' have been generally depicted in the figures as having a spherical or circular profile, it is to be understood that the protrusions can have any number of suitable shapes, including flattened apexes to increase the amount of surface area between the protrusion 38, 38', 39, 39' and the adjacent first or second portions 20, 20', 22, 22' of contact 14, 14' and contact 15, 15'.

In another embodiment of mating contacts 68, FIG. 10 is similar to FIG. 9, with the inclusion of protrusions 64, 64' formed in respective first portions 20, 20'. As shown, protrusions 64, 64' extend outwardly from respective first portions 20, 20' in the same direction as respective protrusions 39, 39' formed in adjacent contact 15, 15' when contacts 14, 14', 15, 15' are coupled. In one embodiment, protrusions 64, 64' are smaller than protrusions 39, 39'. However, protrusions 64, 64' are sized and disposed so that protrusions 64, 64' and corresponding protrusions 39, 39' are aligned when mating contacts 68 are achieved upon assembly of connector assemblies 10, 10'. Once connector assemblies 10, 10' are assembled, upon sufficient movement of contact 14 with respect to contact 15' or of contact 14' with respect to contact 15, protrusions 64, 64' abut indented portion 70, 70' opposite protrusions 39, 39' to resist further movement in the direction of the abutting contact. Stated another way, protrusions 64, 64' act to help maintain abutting protrusions 39, 39' and 38, 38' in abutting contact with each other, providing an enhanced physical and electrical contact between mating contacts 68.

Figure 11:
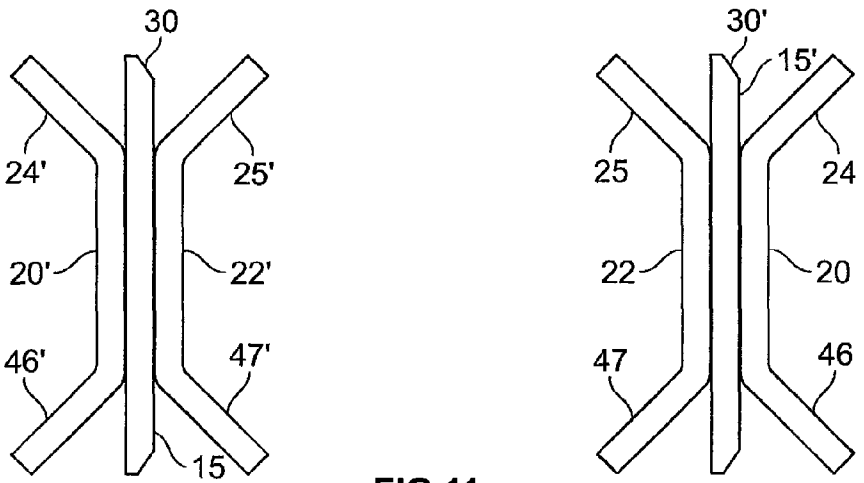

In another embodiment of mating contacts 68, FIG. 11 is similar to FIG. 9, with the exclusion of protrusions 38, 38', 39, 39'. That is, as shown, protrusions 38, 38', 39, 39' are substantially absent.

Figure 12:
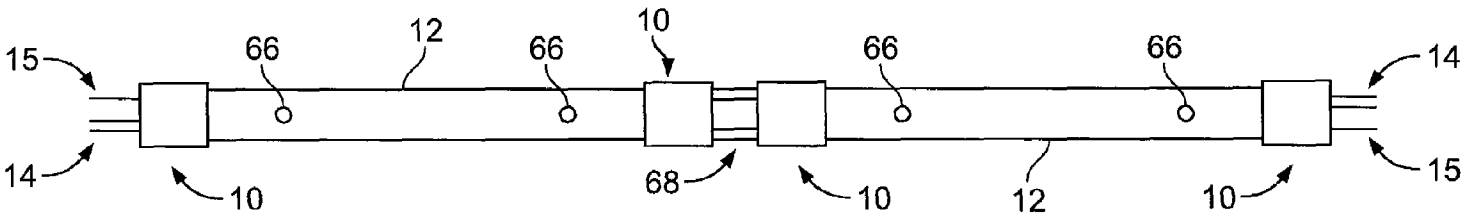
FIG. 12 is an elevation view of an application showing a pair of coupled connectors of different panel members of the present invention.

Referring to FIG. 12, an application of connector assemblies 10 with panel members 12 is discussed. As shown, panel members 12 contain light emitting diodes 66 for providing illumination to a structural space (not shown). Panel members 12 are secured in position, such as by an adhesive strip, so that once affixed to a surface of the structural space, removal and interconnection is extremely difficult, if not impossible to achieve. Since the panel members 12 may be of extended length either singly or in total, it is not practical for an installer to pre-assemble all of the panel members 12 together prior to installation. Additionally, once a first panel member 12 is affixed to the structural space surface, it is not possible to slidably couple a second panel member 12 to the first panel member 12 using conventional "straight-on" end-to-end connections. That is, contacts 14, 15 must be configured to permit coupling from different directions, such as direction 58 (FIG. 7), which is permitting by the present invention.

Figure 15:
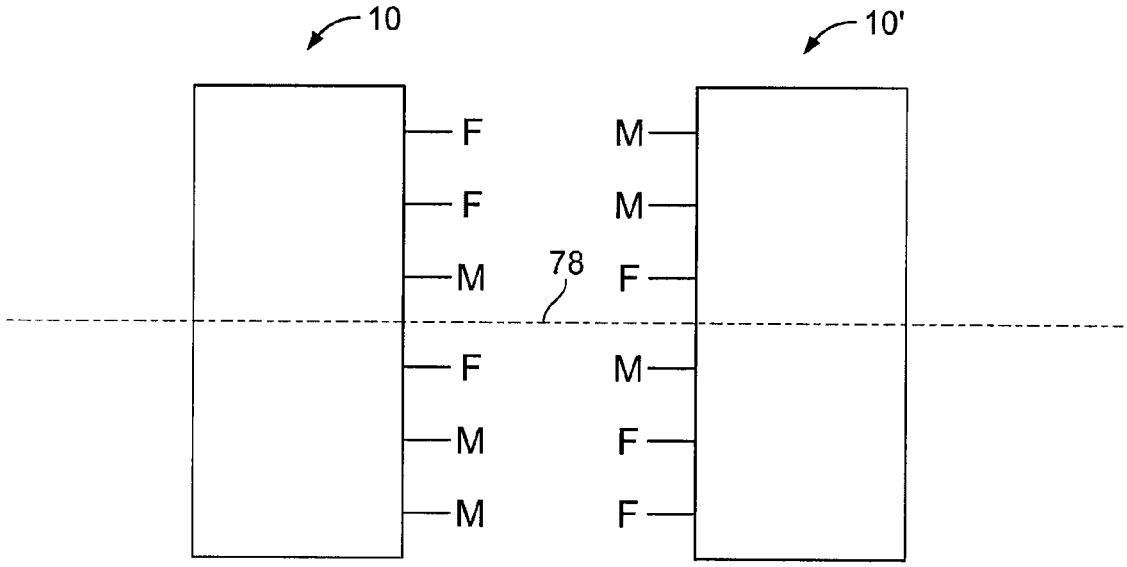
FIG. 15 is a schematic representation of one embodiment of mating hermaphroditic connector assemblies of the present invention.

It is to be understood that although one set of contacts 14, 15 and contacts 14', 15' are respectively shown for hermaphroditic connector assemblies 10, 10' in FIG. 6, any multiple of contacts 14, 15 and contacts 14', 15' can be arranged on other embodiments of connector assemblies 10, 10', so long as the same number of contacts 14, 14' and contacts 15, 15' are arranged symmetrically on each side of the centerline 78 of the connector assembly 10, 10'. For ease of illustration, referring to FIG. 15, contacts 14, 14' are represented as F, F', since contacts 14, 14' are female contacts, and contacts 15, 15' are represented as M, M', since contacts 15, 15' are male contacts. Stated another way, as shown in FIG. 15, there is one F contact immediately adjacent to centerline 78 on one side of centerline 78 of the connector assembly 10, so there must be one M contact immediately adjacent to centerline 78 on the opposite side of centerline 78 of the connector assembly 10. Similarly, the two M contacts disposed along the outer positions on one side of centerline 78 of connector assembly 10 corresponds to the two F contacts disposed along the outer positions on the other side of centerline 78 of connector assembly 10.

It is to be understood that while the connector assemblies shown contain one pair of connector contacts secured in a housing, that one connector contact or more than two connector contacts can be contained in a housing to form a connector assembly. Further, a plurality of connector assemblies can be used to interconnect adjacent panel members.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly secured to a panel member for electrically coupling with a second connector assembly secured to a second panel member, each of the connector assemblies comprising:

a first contact having a first portion and a second portion disposed at a first predetermined spacing from each other;

a second contact disposed a second predetermined spacing from the second portion, the first predetermined spacing of the first contact being configured and disposed to receive the second contact of the second connector assembly; and wherein the second contacts and corresponding first contacts of the connector assembly and second connector assembly are capable of forming pivotable connections; and wherein the second portion and corresponding predetermined first spacing of the connector assemblies can be brought together from a plurality of directions.

2. The connector assembly of claim 1 wherein a protrusion is formed in at least one of the first and second portion of the first contact and the second contact, the protrusion formed in the first portion extending toward the corresponding second portion, the protrusion formed in the second portion extending toward the corresponding first portion, whereupon there being at least two protrusions, two protrusions extending toward each other upon coupling of the connector assemblies.

3. The connector assembly of claim 2 wherein at least one of the first and second portion has an angled region.

4. The connector assembly of claim 3 wherein the angled region extends along at least a portion of the periphery of at least one of the first and second portion.

5. The connector assembly of claim 1 wherein the first and second contact of the connector assembly and second connector assembly are substantially identical.

6. The connector assembly of claim 5 wherein the first and second portion of the connector assembly and second connector assembly are substantially parallel.

7. The connector assembly of claim 1 wherein at least a portion of the periphery of at least one of the first and second portion includes a taper.

8. The connector assembly of claim 1 wherein the panel members can be maintained parallel or non-parallel to each other while the connectors are brought together.

9. The connector assembly of claim 1 wherein the corresponding first and second contacts of the connector assembly and second connector assembly are hermaphroditic.

10. A panel member electrically connectable to a second panel member, the panel member comprising:

a connector assembly secured to the panel member for electrically coupling with a second connector assembly secured to the second panel member, each of the connector assemblies comprising:

a first contact having a first portion and a second portion disposed at a first predetermined spacing from each other;

a second contact disposed a second predetermined spacing from the second portion, the first predetermined spacing of the first contact being configured and disposed to receive the second contact of the other connector; and wherein the second contacts and corresponding first contacts of the connector assembly and second connector assembly are capable of forming pivotable connections; and wherein the second portion and corresponding predetermined first spacing of the connector assemblies can be brought together from a plurality of directions.

11. The panel member of claim 10 wherein a protrusion is formed in at least one of the first and second portion of the first contact and the second contact, the protrusion formed in the first portion extending toward the corresponding second portion, the protrusion formed in the second portion extending toward the corresponding first portion, whereupon there being at least two protrusions, two protrusions extending toward each other upon coupling of the connector assemblies.

12. The panel member of claim 11 wherein at least one of the first and second portion has an angled region.

13. The panel member of claim 12 wherein the angled region extends along at least a portion of the periphery of at least one of the first and second portion.

14. The panel member of claim 10 wherein the first and second connector assemblies are substantially identical.

15. The panel member of claim 14 wherein the first and second portions are substantially parallel.

16. The panel member of claim 10 wherein at least a portion of the periphery of at least one of the first and second portions includes a taper.

17. The panel member of claim 10 wherein the panel members can be maintained parallel or non-parallel to each other while the connector assemblies are brought together.

18. The panel member of claim 10 wherein the corresponding first and second contacts of the connector assembly and second connector assembly are hermaphroditic.

* * * * *